US005920936A

United States Patent [19]

Wiedeck et al.

[11] Patent Number: 5,920,936

[45] Date of Patent: Jul. 13, 1999

[54] HINGE COUPLINGS FOR THE SIDE WALLS OF A TROUGH BRIDGE

[75] Inventors: Hans-Norbert Wiedeck, Mülheim; Hans-Joachim Berlin, Duisburg, both of Germany

[73] Assignee: Krupp Fördertechnik GmbH, Essen, Germany

[21] Appl. No.: 08/909,105

[22] Filed: Aug. 12, 1997

[30] Foreign Application Priority Data

Aug. 14, 1996 [DE] Germany ..... 196 32 741
May 7, 1997 [DE] Germany ..... 197 19 300

[51] Int. Cl.[6] ..... E01D 19/04

[52] U.S. Cl. ..... 14/14; 14/13; 14/73

[58] Field of Search ..... 404/56; 14/13, 14/14, 69.5, 71.1, 73, 78; 16/386

[56] References Cited

U.S. PATENT DOCUMENTS 1,462,541 7/1923 Gallagher .

FOREIGN PATENT DOCUMENTS 0 263 628 11/1988 European Pat. Off. .
0 290 405 11/1988 European Pat. Off. .
34 26 397 1/1986 Germany .
0290405 9/1988 Germany ..... 14/2.4
666 500 7/1988 Switzerland .

*Primary Examiner*—Thomas B. Will
*Assistant Examiner*—Raymond Addie
*Attorney, Agent, or Firm*—VENABLE; Gabor J. Kelemen

[57] ABSTRACT

A trough bridge is composed of a plurality of interconnected bridge sections each formed of a roadway deck segment and side wall segments located at opposite sides of the roadway deck segment. An articulation for pivotally attaching the side wall segments to each roadway deck segment includes spaced and aligned first hinge sleeves affixed to the roadway deck segment; a separate first hinge recess defined next to each first hinge sleeve; spaced and aligned second hinge sleeves affixed to the side wall segments; and a separate second hinge recess defined next to each second hinge sleeve. In an assembled state the first hinge sleeves are received in respective second hinge recesses and the second hinge sleeves are received in respective first hinge recesses. The first and second hinge sleeves are in alignment with one another. A hinge pin passes through the first and second hinge sleeves for pivotally joining the side wall segments to the roadway deck segment. There is further provided a locking arrangement for immobilizing the side wall segments in a predetermined pivotal position relative to the roadway deck segment.

16 Claims, 5 Drawing Sheets

HINGE COUPLINGS FOR THE SIDE WALLS OF A TROUGH BRIDGE

CROSS REFERENCE TO RELATED APPLICATION

This application claims the priority of German Application Nos. 196 32 741.5 filed Aug. 14, 1996 and 197 19 300.5 filed May 7, 1997, which are incorporated herein by reference.

BACKGROUND OF THE INVENTION

This invention relates to a trough bridge which is composed of bridge sections, each having a roadway deck segment and side wall segments. At least one side wall segment is articulated to each side of a roadway deck segment.

Since the side walls of a trough bridge of the above-outlined type have to take up large upper chord forces when the bridge is loaded, the side walls have to be secured against outward buckling. In permanent bridges such a securement is generally effected by providing the upper chord with frame-like stiffening structures at defined distances.

In mobile bridges which are composed of individual components, the stability of the side walls is ensured by arranging, at predetermined distances, stabilizing struts which support the upper chord. Such structures have the disadvantage that they are expensive and take up additional volume in transport.

As disclosed, for example, in published European Patent Application 0 290 405, it is known to form the side walls of mobile bridges as box-like structures. For connecting the roadway deck segments with the lateral walls, eyelets are provided which are arranged in pairs. In this construction one eyelet carried by the roadway deck segment and another eyelet carried by the side wall segment form a hinge which allows the bridge components to be folded together. The eyelet carried by the roadway deck segment is in alignment with the eyelet carried by the side wall segment in the folded condition of the bridge components. A pin may be inserted through the eyelets and thus a rigid connection of the two components is obtained. Such a bridge too, is involved with significant expense and requires a substantial volume for transport.

German offenlegungsschrift (application published without examination) 34 26 397 discloses a hinge for a folding articulation of two bridge components in which each bridge component is provided with eyelets. A pin is inserted through the eyelets of two adjoining bridge components, and the length of the pin is so designed that one half is received in one eyelet and the other half is received in the adjoining, other eyelet. Such a hinge is not adapted to transmit tension forces.

SUMMARY OF THE INVENTION

It is an object of the invention to provide an improved trough bridge of the above-outlined type from which the discussed disadvantages of known trough bridges are eliminated and which makes possible a flexurally rigid connection between the roadway deck segments and the side wall segments with simple means and which requires a significantly reduced volume for transport as compared to prior art structures.

This object and others to become apparent as the specification progresses, are accomplished by the invention, according to which, briefly stated, the trough bridge is composed of a plurality of interconnected bridge sections each formed of a roadway deck segment and side wall segments located at opposite sides of the roadway deck segment. An articulation for pivotally attaching the side wall segments to each roadway deck segment includes spaced and aligned first hinge sleeves affixed to the roadway deck segment; a separate first hinge recess defined next to each first hinge sleeve; spaced and aligned second hinge sleeves affixed to the side wall segments; a separate second hinge recess defined next to each second hinge sleeve. In an assembled state the first hinge sleeves are received in respective second hinge recesses and the second hinge sleeves are received in respective first hinge recesses. The first and second hinge sleeves are in alignment with one another. A hinge pin passes through the first and second hinge sleeves for pivotally joining the side wall segments to the roadway deck segment. There is further provided a locking arrangement for immobilizing the side wall segments in a predetermined pivotal position relative to the roadway deck segment.

The hinge pin has the function to connect the roadway deck segments with the side wall segments. The hinge pin simultaneously serves as a tension element while the interfitting hinge sleeves assume the pushing connection between the roadway deck segment and the respective side wall segment.

By means of the locking devices the side wall segments are, in the upwardly pivoted position, non-rotatably connected with the respective roadway deck segments.

To maintain the number of loose parts as small as possible, the hinge pins are formed as insertion stubs which are fixedly attached to the hinge sleeves of the roadway deck segments or, as the case may be, to the hinge sleeves of the side wall segments. The insertion stubs extend into the hinge sleeves of the side walls or, as the case may be, into the hinge sleeves of the roadway deck segments.

According to an advantageous feature of the invention, the hinge pins or insertion stubs are formed as shaped hollow members and thus are light-weight components.

According to an advantageous feature of the invention, the hinge sleeves and the hinge pins (or the insertion stubs, as the case may be) have transverse apertures in which transverse securing pins are inserted. In this manner a simple but reliable connection between the hinge sleeves and the hinge pins (or insertion stubs) is provided. The transverse securing pins further function as a flexure-resistant connection between the roadway deck segments and the side wall segments of the trough bridge, whereby a stabilizing of the upper chord is ensured.

According to a further feature of the invention, the hinge sleeves and the hinge pins (or insertion stubs) are provided with mutually engaging cleats. This arrangement too, enhances a flexure-resistant connection between the roadway deck segments and the side wall segments, for example, in such a manner that pressing forces from the roadway deck segments are transmitted to the side wall segments by means of the cleats in the hinge sleeves of the side wall segments and the corresponding cleats of the hinge pins or insertion stubs.

Since the interengaging state of the cleats ensures that a rotation of the side wall segments relative to the roadway deck segments is not possible, according to a further advantageous feature of the invention the length of the cleats situated on the hinge pins (or insertion stubs) approximately corresponds to the length of the hinge recesses (that is, the space between two adjoining hinge sleeves of a roadway deck segment or the space between two adjoining hinge sleeves of a side wall segment). During transport of the bridge, the hinge pins (or insertion stubs) are pushed into the hinge sleeves of the roadway deck segments and into the hinge sleeves of the side wall segments such that the cleats will be situated in the region of the recesses, whereby the side wall segments may freely rotate relative to the roadway deck segments.

For the operational state of the trough bridge the hinge pins (or insertion stubs) are shifted one-half the hinge length so that the cleats of the hinge sleeves interengage the cleats of the hinge pins.

To ensure that in the region of the cleats additional material is available for taking up the forces applied by the transverse securing pins, according to an advantageous feature of the invention the bore holes for the transverse securing pins are situated in the region of the cleats of the hinge pins.

According to a further feature of the invention, in the zone between two end-to-end adjoining bridge sections a preferably hollow (sleeve-like) coupling element of circular cross section is provided, whose outer diameter is slightly less than the inner diameter of the insertion stubs and which is inserted into the ends of two adjoining insertion stubs. The length of the coupling element is so designed that it extends over at least one of the transverse pin bores provided in the insertion stubs. The coupling element transmits forces from one insertion stub to another.

It is furthermore advantageous to provide also the coupling elements with a suitable thickening in the zone of the transverse pin bores so that there too, sufficient material thickness is available for taking up forces from the transverse securing pins.

The locking devices for locking the hinge sleeves of the side wall segments to the hinge sleeves of the roadway deck segments may also be constructed such that on each roadway deck segment, in the zone of the articulation with the side wall segments, at the height of the roadway surface, in each instance two adjoining cleats are provided, whose distance from one another is slightly greater than the thickness of the side wall segments. Upon insertion of the hinge sleeve of one side wall segment in the insertion stub of the corresponding roadway deck segment, the cleats simultaneously form a guide for the hinge recesses of the respective side wall segment.

According to a further feature of the invention, a continuous, tensioned stressing anchor (expediently a tensioned cable) is passed through the hinge sleeves of the roadway deck segments and the hinge sleeves of the side wall segments. By means of the tensioned anchor the hinge sleeves of the roadway deck segments and the hinge sleeves of the side wall segments may be prestressed in such a manner that under operational load conditions the tension forces derived from the load bearing function of the trough bridge are less than the pretensioning force of the anchor. This arrangement is advantageous in that in the lower chord the tension stresses are overcompensated by pressing forces so that lower chord couplings for tensioning forces may be dispensed with.

According to still another advantageous feature of the invention, the transverse end faces of the roadway deck segments and the transverse end faces of the side wall segments are provided with slide pins and bore holes dimensioned and arranged such that in the assembled state of the trough bridge the slide pins of one roadway deck segment or side wall segment extend into the bores of the adjoining respective roadway deck segment or adjoining side wall segment. In this manner, a uniform take-up of load is ensured.

According to still another preferred embodiment of the invention, the roadway deck segments are offset with respect to the side wall segments such that the side wall segments—with the exception of the first and last side wall segments—extend over one-half of the length (measured in the direction of bridge length) of two roadway deck segments. In this manner a particularly high flexural rigidity of the trough bridge is ensured.

DESCRIPTION OF THE PREFERRED EMBODIMENTS

Figure 1:
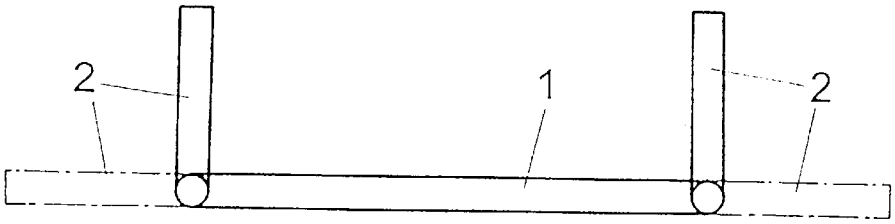
FIG. 1 is a schematic front elevational view of a trough bridge incorporating the invention.

The trough bridge illustrated in FIG. 1 has a roadway deck 1 flanked by side walls 2 which may be pivoted into an inoperative, phantom-line position.

Figure 2:
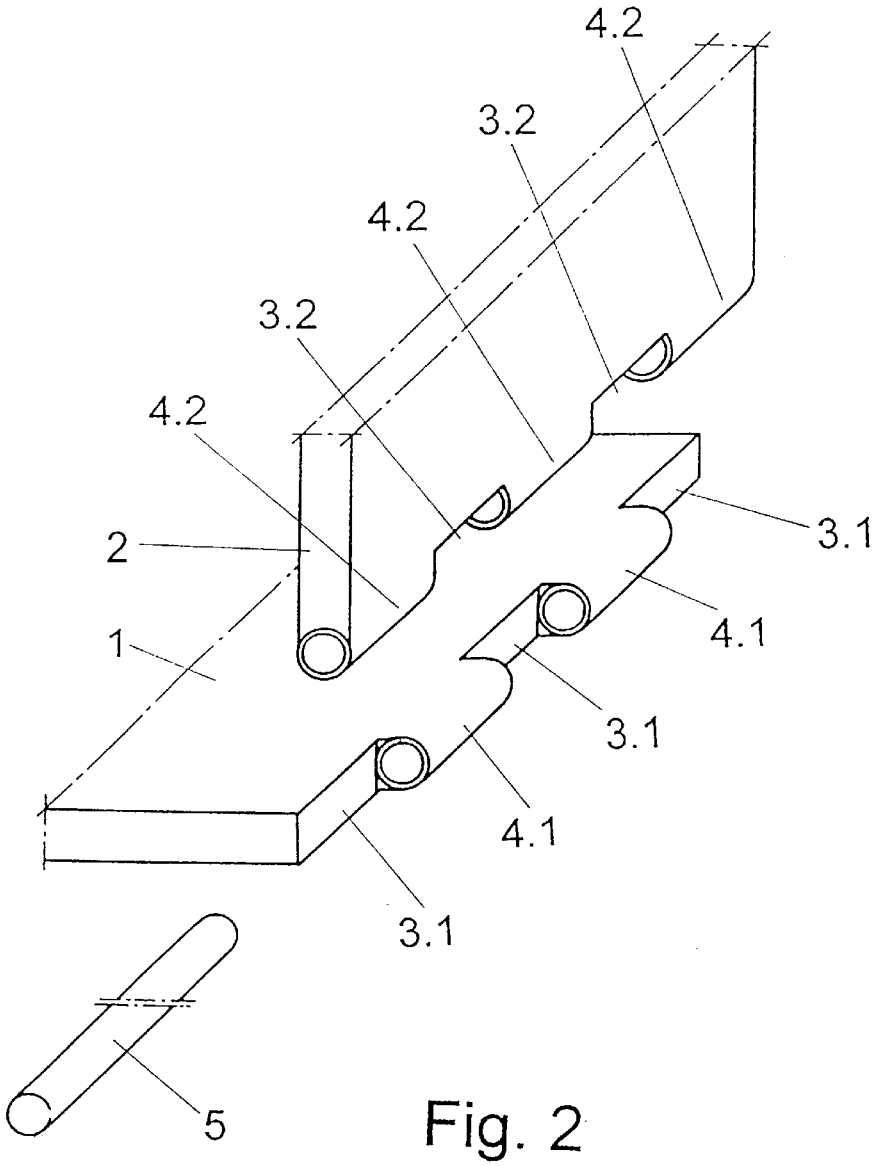
FIG. 2 is a schematic, exploded, fragmentary perspective view of a bridge segment of a trough bridge composed of a roadway deck segment and a side wall segment according to the invention.

FIG. 2 shows adjoining zones of a roadway deck segment 1 and one side wall segment 2 of a trough bridge. The trough bridge is composed of longitudinally serially arranged bridge sections wherein each section is formed of a roadway deck segment 1 and oppositely located side wall segments 2. The roadway deck segment 1 has along its longitudinal edge projections which constitute spaced hinge sleeves 4.1, whereas the side wall segment 2 has along its longitudinal edge projections which constitute spaced hinge sleeves 4.2. Between adjoining two hinge sleeves 4.1 and between adjoining two hinge sleeves 4.2 respective hinge recesses 3.1 and 3.2 are defined. The hinge recesses 3.1 and 3.2 as well as the hinge sleeves 4.1 and 4.2 fit into one another in an alternating series in the assembled condition. The hinge sleeves 4.1 of the roadway deck segments 1 and the hinge sleeves 4.2 of the side wall segments 2 are connected to one another in the assembled state by a hinge pin 5 to thus form a pivoting articulation.

Figure 3:
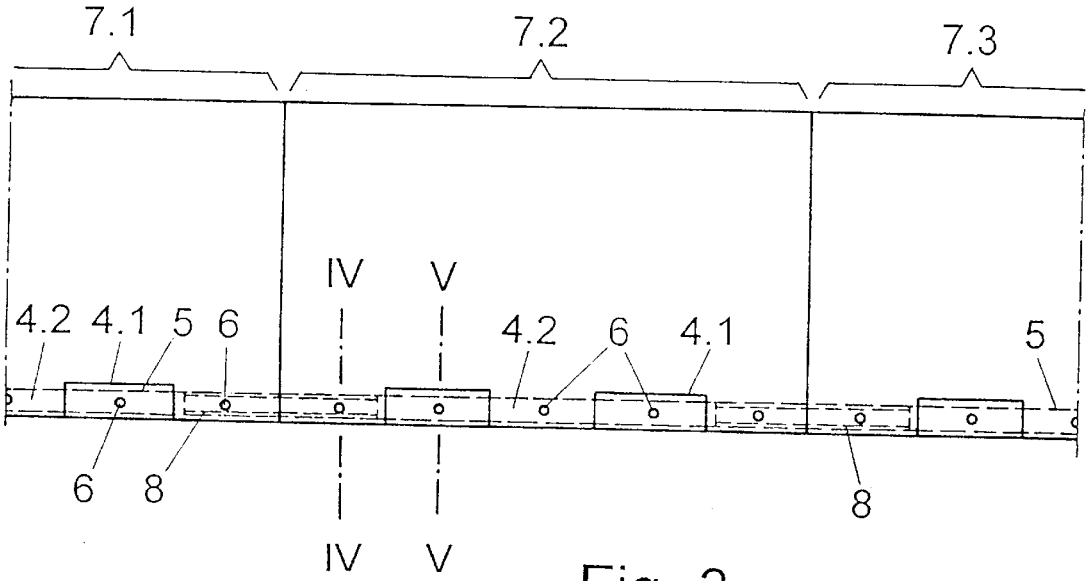
FIG. 3 is a fragmentary schematic side elevational view of the trough bridge shown in FIG. 1.
Figure 4:
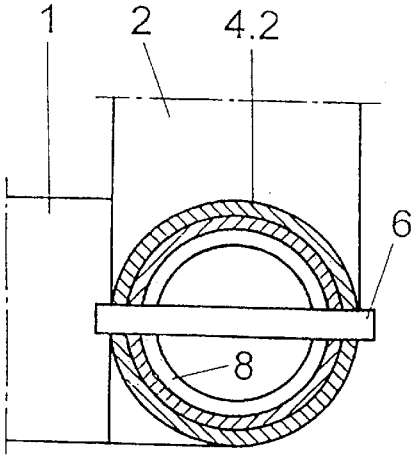
FIG. 4 is a sectional view taken along line IV—IV of FIG. 3.
Figure 5:
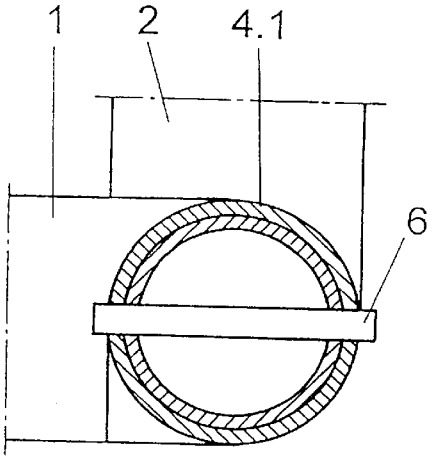
FIG. 5 is a sectional view taken along line V—V of FIG. 3.
Figure 6:
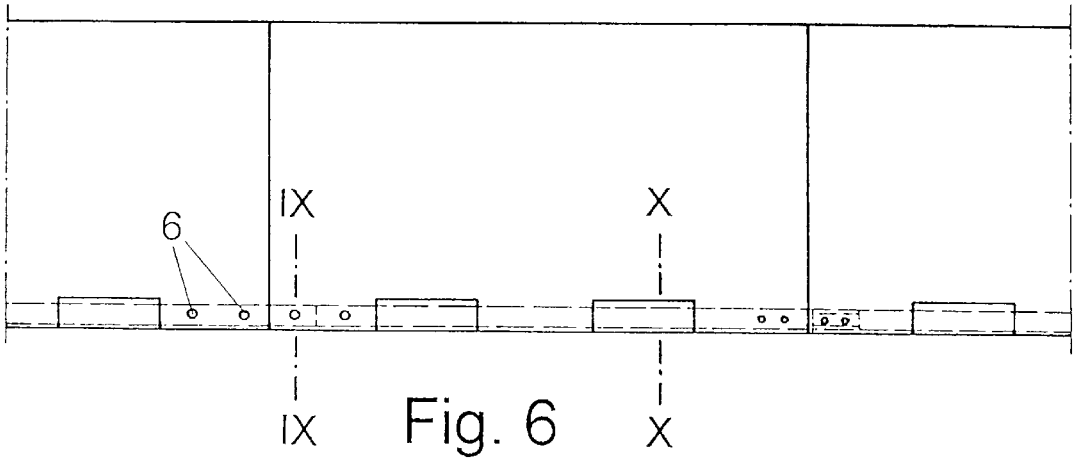
FIG. 6 is a view similar to FIG. 3, illustrating another embodiment of the invention.

Referring to FIGS. 3, 4 and 5, the hinge sleeves 4.1 of the roadway deck segments 1, the hinge sleeves 4.2 of the side wall segments 2 and the hinge pin 5 have mutually aligned, transversely extending bores in which transverse securing pins 6 are inserted. In the region between two adjoining bridge sections 7.1 and 7.2 or 7.2 and 7.3 coupling elements 8 are provided. Each coupling element 8 is received in the end portions of two abutting hinge pins 5. The length of each coupling element 8 is designed such that it extends over at least one of the transverse bores for the transverse pins 6 passing through the hinge pin 5.

Figure 7:
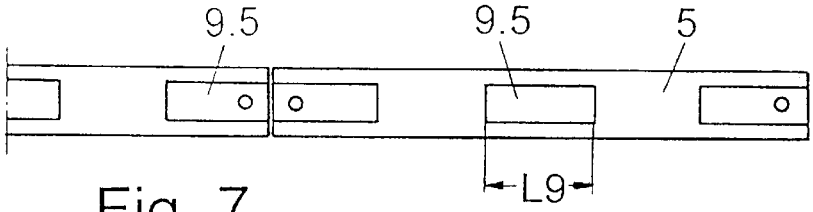
FIG. 7 is a side elevational view of a hinge pin according to the invention.
Figure 8:
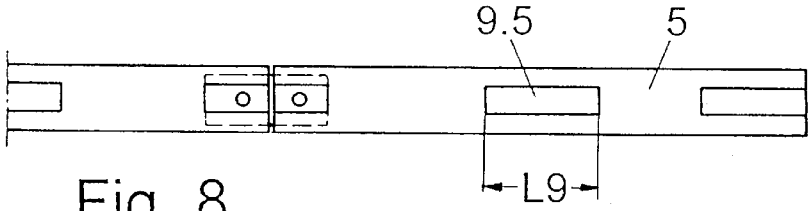
FIG. 8 is a side elevational view of a hinge pin according to another embodiment of the invention.
Figure 9:
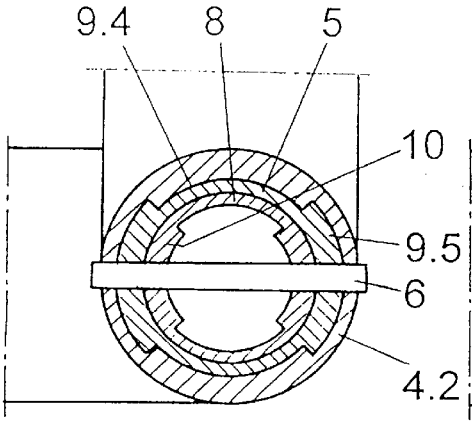
FIG. 9 is a sectional view taken along line IX—IX of FIG. 6.
Figure 10:
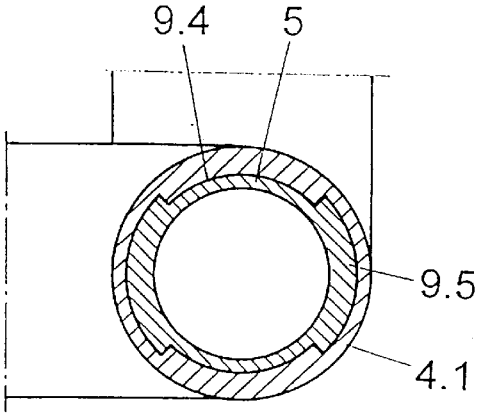
FIG. 10 is a sectional view taken along line X—X of FIG. 6.

In the embodiments illustrated in FIGS. 6–10, the hinge sleeves 4.1 and 4.2 as well as the hinge pins 5 are provided with cleats 9.4 and 9.5 which are configured such that they extend into one another. The transverse bores for the transverse pins 6 are situated in the region of the cleats 9.5 of the hinge pin 5. Expediently, the length L9 of the cleat 9.5 situated on the hinge pin 5 is, as illustrated in FIGS. 7 and 8, approximately the same as the length of the recesses 3.1 and 3.2 shown in FIG. 2.

Figure 11:
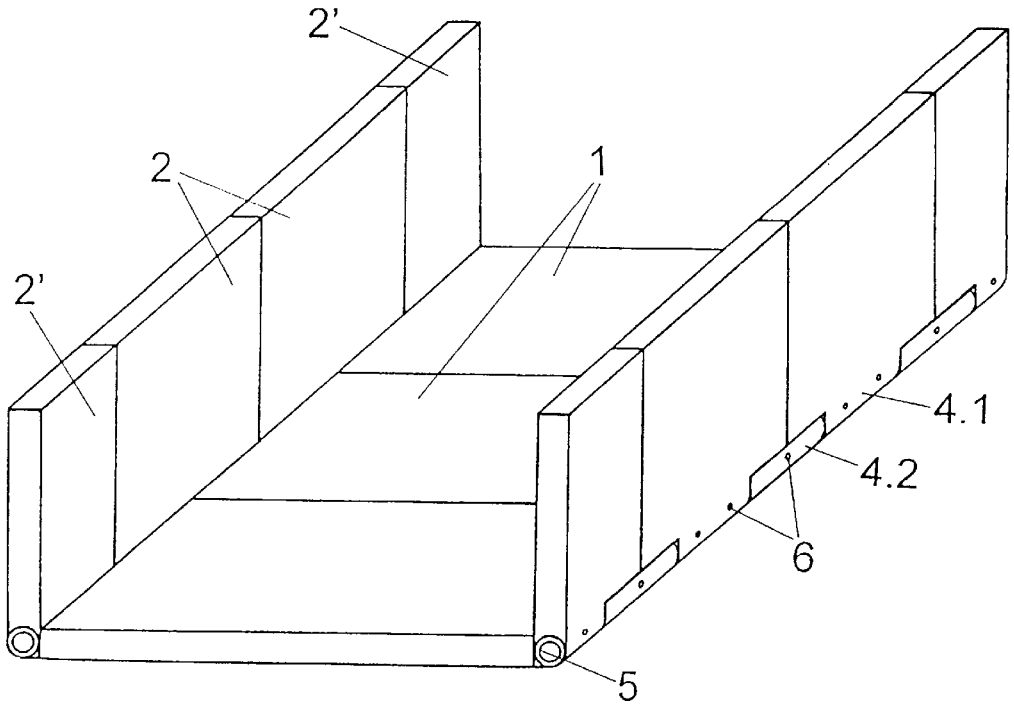
FIG. 11 is a schematic perspective view of yet another embodiment of the trough bridge according to the invention.

In the trough bridge illustrated in FIG. 11, the side wall segments 2 are arranged offset relative to the roadway segments 1 in such a manner that the side wall segments 2, with the exception of the two outermost side wall segments 2', extend over one-half the length (viewed parallel to the bridge length) of two adjoining roadway deck segments 1. For locking the hinge sleeves 4.1 of the roadway deck segments 1 and the hinge sleeves 4.2 of the side wall segments 2 by means of the hinge pins 5, the transverse securing pins 6 extending through transverse bores are used.

Figure 12:
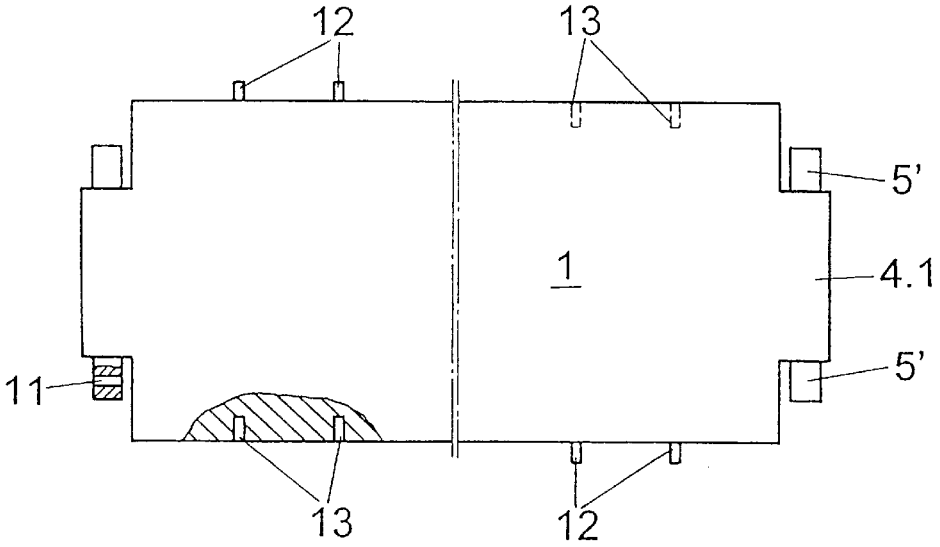
FIG. 12 is a top plan view of a roadway deck segment forming part of the structure shown in FIG. 11.
Figure 13:
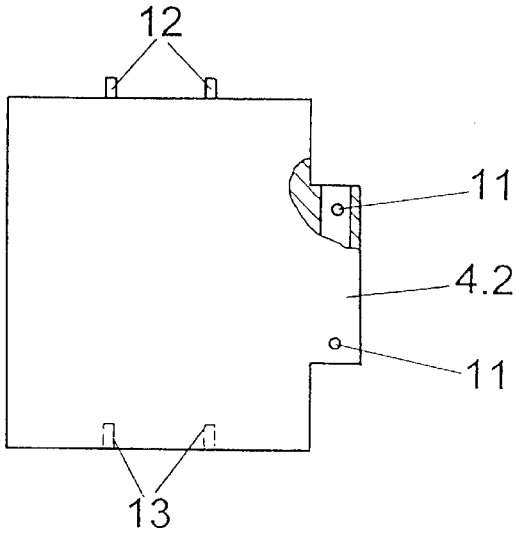
FIG. 13 is a top plan view of a flat-lying side wall segment of the trough bridge illustrated in FIG. 11.

In FIG. 12 one roadway deck segment 1 of the trough bridge is shown. The hinge pins are formed as insertion stubs 5' and are fixedly attached to opposite ends of the hinge sleeve 4.1 of the roadway deck segment 1. In the assembled state of the bridge section, the insertion stubs 5' extend into the hinge sleeves 4.2 of the side wall segments 2 as shown in FIG. 13. In the alternative, it is feasible to arrange the insertion stubs 5' at opposite ends of the hinge sleeves 4.2 of the side wall segments 2 in which case the insertion stubs 5' extend into the hinge sleeves 4.1 of the roadway deck segment 1.

For locking the side wall segments 2 in the upwardly pivoted position (FIG. 11), the insertion stubs 5' fixedly attached to the side wall segments 2 and the hinge sleeves 4.2 of the side wall segments 2 (FIG. 13) or, as the case may be, the hinge sleeves 4.1 of the roadway deck segments 1 are provided with transverse bores 11 to receive the transverse securing pins 6 as shown in FIG. 11.

As shown in FIG. 12, the end faces of the roadway deck segments 1 and similarly, although not shown, the end faces of the side wall segments 2, are provided with dowels 12 and corresponding bore holes 13 so that in the assembled state of the bridge sections, the dowels of one roadway deck segment 1 extend into the aligned bore holes of the longitudinally adjoining other roadway deck segment 1 and/or the dowels of one side wall segment 2 extend into the aligned bore holes of the longitudinally adjoining other side wall segment 2.

Figure 14:
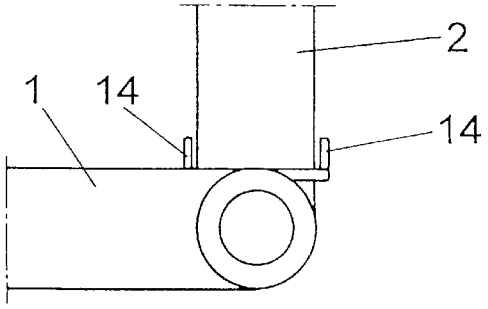
FIG. 14 is a front elevational view illustrating the region of an articulated connection between a roadway deck segment and a side wall segment of another embodiment of the invention.

A locking of the side wall segments 2 in the upwardly pivoted state may be effected—as illustrated in FIG. 14, by arranging on each roadway deck segment 1, at the height of the travel surface, two side-by-side disposed cleats 14 whose distance from one another is slightly greater than the thickness of the side wall segments 2.

Figure 15:
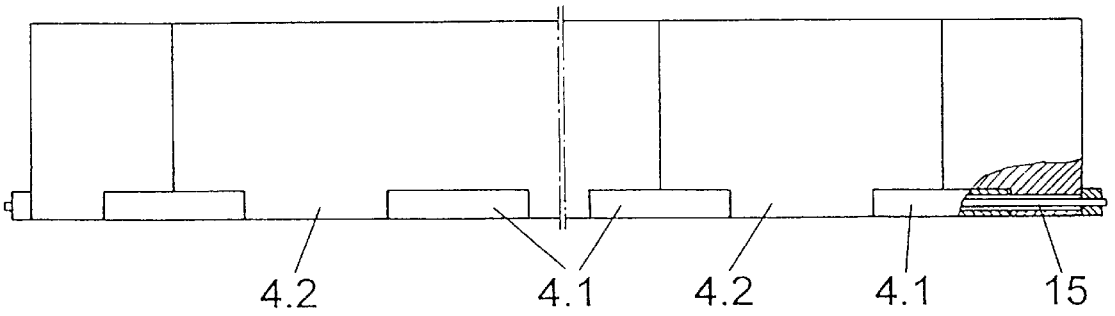
FIG. 15 is a schematic side elevational view of a trough bridge provided with a throughgoing tensioning cable.

As illustrated in FIG. 15, a conventionally tensioned anchor such as a cable 15 may pass through the aligned hinge sleeves 4.1 and hinge sleeves 4.2.

It will be understood that the above description of the present invention is susceptible to various modifications, changes and adaptations, and the same are intended to be comprehended within the meaning and range of equivalents of the appended claims.

What is claimed is:

1. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; said hinge pin means being composed of a plurality of insertion stubs fixedly attached to said first hinge sleeves and extending into adjoining, respective second hinge sleeves in said assembled state; and (f) locking means for immobilizing said side wall segments in a predetermined pivotal position relative to said roadway deck segment.

2. In a trough bridge composed of a plurality of interconnected bridge sections; each bridge section being formed of a roadway deck segment each having an upper roadway deck surface; and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; and (f) locking means for immobilizing said side wall segments in a predetermined pivotal position relative to said roadway deck segment; said locking means comprising two side-by-side arranged cleats mounted on each roadway deck segment in a zone of said articulating means at a height level of said upper roadway deck surfaces at a distance from one another; said distance being slightly greater than a thickness of said side wall segments for receiving a side wall segment between said two cleats.

3. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means;

(f) locking means for immobilizing said side wall segments in a predetermined pivotal position relative to said roadway deck segment; and (g) a tensioning anchor passing through said first and second hinge sleeves of said bridge sections when assembled into a series to form the trough bridge.

4. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment; said roadway deck segments and said side wall segments having transverse terminal edges;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means;

(f) locking means for immobilizing said side wall segments in a predetermined pivotal position relative to said roadway deck segment; and (g) dowels and dowel-receiving holes provided on said transverse terminal edges; said dowels being in alignment with and projecting into respective said dowel-receiving holes when said bridge sections are assembled into a series to form the trough bridge.

5. A trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment; said side wall segments and said roadway deck segments forming longitudinally arranged series in the trough bridge; each said series of side wall segments having two outer side wall segments at opposite ends of the trough bridge; said side wall segments of each side wall segment series being offset relative to said roadway deck segment series such that with the exception of said outer side wall segments, each said side wall segment extends along one half of a length of adjoining roadway deck segment; said length being parallel to a length of said trough bridge; further comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; and (f) locking means for immobilizing said side wall segments in a predetermined pivotal position relative to said roadway deck segment.

6. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; said hinge pin means comprising a plurality of insertion stubs fixedly attached to said second hinge sleeves and extending into adjoining, respective first hinge sleeves in said assembled state; and (f) locking means for immobilizing said side wall segments in a predetermined pivotal position relative to said roadway deck segment.

7. The trough bridge as defined in claim 6, wherein said insertion stubs are hollow.

8. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; said hinge pin means comprising a single hinge pin for each said side wall segment; and (f) locking means for immobilizing said side wall segments in a predetermined pivotal position relative to said roadway deck segment.

9. The trough bridge as defined in claim 8, wherein said hinge pin is hollow.

10. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; and (f) locking means for immobilizing said side wall segments in a predetermined pivotal position relative to said roadway deck segment; said locking means comprising cleats carried by said first and second hinge sleeves and said hinge pin means and said cleats carried by said first end second hinge sleeves interengaging with said cleats carried by said hinge pin means.

11. The trough bridge as defined in claim 10, wherein a length of said cleats carried by said hinge pin means is approximately the same as a length of said first and second hinge recesses and wherein in an inoperative state of said locking means said hinge pin means assume a pushed-in position in said first and second hinge sleeves such that cleats are situated in said first and second hinge recesses for allowing said side wall segments to freely pivot relative to said roadway deck segment.

12. The trough bridge as defined in claim 10, wherein said locking means comprises (a) transverse holes provided in said first and second insertion stubs and said pin means; said transverse holes being arranged in a region of said cleats carried by said pin means; and (b) a transverse securing pin passing through said transverse holes aligned in said predetermined pivotal position.

13. In a trough bridge composed of a plurality of interconnected bridge sections; each bridge section being formed of a roadway deck segment and side wall segments located at opposite sides of said roadway deck segment and articulating means for pivotally attaching said side wall segments to said roadway deck segment;

the improvement comprising (a) spaced and aligned first hinge sleeves affixed to said roadway deck segment;

(b) a separate first hinge recess defined next to each first hinge sleeve;

(c) spaced and aligned second hinge sleeves affixed to said side wall segments;

(d) a separate second hinge recess defined next to each second hinge sleeve; in an assembled state said first hinge sleeves being received in respective said second hinge recesses and said second hinge sleeves being received in respective said first hinge recesses and said first and second hinge sleeves being in alignment with one another;

(e) hinge pin means passing through said first and second hinge sleeves for pivotally joining said side wall segments to said roadway deck segment; said first and second hinge sleeves, said first and second hinge recesses and said hinge pin means forming said articulating means; and (f) locking means for immobilizing said side wall segments in a predetermined pivotal position relative to said roadway deck segment; said locking means comprising (1) transverse holes provided in said first and second hinge sleeves and said pin means; and (2) a transverse securing pin passing through said transverse holes aligned in said predetermined pivotal position.

14. The trough bridge as defined in claim 13, further comprising a coupling element of circular cross section situated in a zone of two adjoining bridge sections; said hinge pin means being hollow and having an inner diameter slightly greater than an outer diameter of said coupling element; said coupling element being inserted into abutting ends of two hinge pin means belonging to separate, adjoining bridge sections; said coupling element having a length such that said coupling element extends over at least one of said transverse bores of each of said two hinge pin means.

15. The trough bridge as defined in claim 14, wherein said coupling element is hollow.

16. The trough bridge as defined in claim 14, wherein said coupling element has an enlargement in a region of said transverse bores.

* * * * *